US005746099A

United States Patent [19]

Janson

[11] Patent Number: 5,746,099

[45] Date of Patent: May 5, 1998

[54] ADJUSTABLE OPEN-WRENCH WITH A SLIDING SIDE JAW HAVING A RELEASABLE ADJUSTMENT MECHANISM TO ALLOW RATCHETING OPERATION

[76] Inventor: Paul Janson, 19151 Tulsa St., Northridge, Calif. 91326

[21] Appl. No.: 725,777

[22] Filed: Oct. 4, 1996

[51] Int. Cl.[6] ..... B25B 13/16

[52] U.S. Cl. ..... 81/165; 81/151; 81/DIG. 3

[58] Field of Search ..... 81/157, 165, DIG. 3

[56] References Cited

U.S. PATENT DOCUMENTS

| | | | |
|---|---|---|---|
| 1,391,251 | 9/1921 | Ginsburg | 81/DIG. 3 X |
| 1,599,162 | 9/1926 | Brown | 81/DIG. 3 X |
| 3,022,689 | 2/1962 | McComb | 81/165 |
| 3,174,366 | 3/1965 | Fujii | 81/165 |

*Primary Examiner*—James G. Smith

*Attorney, Agent, or Firm*—John J. Posta, Jr.

[57] ABSTRACT

An adjustable sliding jaw wrench is disclosed which has a sliding jaw adjustment mechanism operated by a worm gear rotatably mounted in an opening in the wrench head, the worm gear driving a rack member to which the sliding jaw is attached. The worm gear is substantially shorter than the width of the opening in the wrench head in which it is mounted, and is spring biased into an operating position. A sliding locking member is movable between a locked position which will mechanically maintain the worm gear in its operating position, and an unlocked position in which the worm gear will be permitted to move in a direction opposing the biasing spring. When the locking member is in the locked position, the wrench will retain a fastener engaged by the wrench between the jaws of the wrench to rotate it; however, when the locking member is in the unlocked position, the jaws of the wrench may move apart by urging the worm gear to move in a direction opposing the biasing spring, thereby allowing the fastener to rotatably slip between the jaws of the wrench without itself being rotated.

2 Claims, 3 Drawing Sheets

ADJUSTABLE OPEN-WRENCH WITH A SLIDING SIDE JAW HAVING A RELEASABLE ADJUSTMENT MECHANISM TO ALLOW RATCHETING OPERATION

BACKGROUND OF THE INVENTION

Field of the Invention

The present invention relates generally to the field of hand tools, and more particularly to an improved open-end wrench of the type having a sliding jaw adjustment mechanism operated by a worm gear and a mating rack member in which the sliding jaw may be selectively released from its adjusted position to allow a fastener such as a bolt or nut which is engaged by the wrench to be turned by the wrench in a single direction only, thereby enabling the wrench to be operating in a ratcheting mode of operation.

There exists an expansive array of hand tools of virtually innumerable different types, with each type of hand tool having features designed to facilitate particular tasks. One broad category of such hand tools is the open-end wrench, which is designed to fit onto a bolt or nut or like fastener from the side, in marked contrast to a box-end wrench or a socket, which may only be placed onto the bolt or nut from the top or bottom thereof. One particular type of open-end wrench is the adjustable sliding jaw wrench which uses a worm gear to drive a mating rack formed integrally with the sliding jaw, with the worm gear being rotated to operate the sliding jaw to allow the width of the jaws of the wrench to be adjusted.

While adjustable sliding jaw wrenches, like all open-end wrenches, have the advantage that they can be easily slipped onto or off of a bolt or nut from the side, they also have the disadvantage that they cannot be used to rotate the bolt or nut more than part of a single revolution unless the bolt or nut is freely accessible. While sockets cannot be slipped onto or off of a bolt or nut from the side, they can be driven by a ratchet wrench to allow the bolt or nut to be rotated a desired number of revolutions without requiring that the socket be removed from the bolt or nut. It is readily apparent to those skilled in the art that it would be desirable to combine the ratcheting operation of wrenches typically used to drive sockets with the easy accessibility and adjustable size jaws afforded by adjustable sliding jaw wrenches; the problem is how best to implement such a combination of features.

As might be expected, the art is replete with a number of proposed solutions to the problem described above, with a variety of different approaches being taken. One of the most popular approaches has been to use a pivoting locking arm to engage the nut, with the pivoting arm being released to allow the wrench to rotate without turning the bolt or nut. This approach is illustrated in U.S. Pat. No. 3,190,154 and in U.S. Pat. No. 4,794,824, both to Chapman, in U.S. Pat. No. 4,375,174, to Shanley, Jr., in U.S. Pat. No. 4,995,297, to Richards, in U.S. Pat. No. 5,048,380, to Caldwell, and in U.S. Pat. No. 5,535,650, to McNatt. While these references may be useful in locking a bolt or nut in the jaws of the wrench, they are actually more difficult to operate to repeatedly engage and release the bolt or nut as it is being rotated than is a conventional adjustable sliding jaw wrench. Accordingly, they do not represent the desired solution to the problem described above.

Another approach which is quite simple is illustrated in U.S. Pat. No. 3,948,120, to Hancock. This approach is to drive the head of an adjustable sliding jaw wrench with a ratcheting wrench handle. While this approach is simple, it is not desirable due to the fact that the entire head of the adjustable sliding jaw wrench must rotate, which limits the device's applicability to applications in which the top or bottom of the bolt or nut being driven is exposed.

Still another approach to this problem is to provide the wrench with odd-shaped jaws which grip a portion of the bolt or nut when the wrench is rotated in one direction, and allow the nut to rotate freely within the jaws of the wrench in the other direction. This type of device is illustrated in U.S. Pat. No. 3,916,735 and in U.S. Pat. No. 3,955,450, both to Evans. The wrenches taught in the Evans patents are limited in the amount of torque that may be transmitted to the bolt or nut by the relatively small jaw area which engages the bolt or nut when it is being driven. This disadvantage has limited the popularity of wrenches constructed according to the teachings of the Evans patents.

Yet another approach is taught in U.S. Pat. No. 2,970,502, in U.S. Pat. No. 3,312,129, in U.S. Pat. No. 3,349,654, and in U.S. Pat. No. 3,926,077, all to Nordgren, in U.S. Pat. No. 3,290,970, to De Lucia, in U.S. Pat. No. 3,939,739, to Kotsakis, in U.S. Pat. No. 4,913,011, to Ma, and in U.S. Pat. No. 5,297,459, to Stojanowski. Each of these references teaches a ratcheting wrench for engaging a variety of sizes of bolts or nuts, with the ratcheting mechanisms being based on camming operations in which one or both jaws rotate with respect to the wrench handle. For the most part, these devices are complex and expensive to manufacture, and many of them may also be subject to excessive mechanical wear.

Two other devices taught by the art are also interesting. First, U.S. Pat. No. 5,377,566, to Mandigo, discloses a ratcheting wrench in which an adjustable head is rotatable in a single direction within a semicircular end of a wrench. Aside from being mechanically complex and expensive to manufacture, the Mandigo wrench presents the possibility of tightening a bolt or nut only to find that the wrench may not be removed from the side of the bolt or nut, a distinct disadvantage. Second, U.S. Pat. No. 4,706,528, to Inoue, discloses a wrench having a gripping jaw for engaging round segments such that they are only driven in a single direction. Unfortunately, the Inoue device does not have sufficient jaw movement to enable it to drive bolts or nuts in a ratcheting fashion.

Two other adjustable open-end wrenches which do not have the ratcheting feature are worthy of mention due to the nature of their unique adjustment techniques. U.S. Pat. No. 3,817,128, to Evans, and U.S. Pat. No. 5,209,144, to Lu Guoji, both teach adjustable wrenches in which spring-loaded retaining members are used to retain an adjustable sliding jaw in a preset position. By pulling the retaining member against the force of the spring, the adjustable jaw is freed to be adjusted. This simple technique is highly effective; unfortunately, however, neither of these devices are adaptable to a ratcheting mode of operation.

It is accordingly the primary objective of the present invention that it provide an adjustable sliding jaw wrench which has a ratcheting mode of operation to allow the wrench to rotate a bolt or nut in a single direction only without requiring that the wrench periodically be removed from the bolt or nut to return it to an operable position. It is a related objective of the adjustable sliding jaw wrench of the present invention that it be of open-end construction, and that the open end of the wrench remain open at all times during its operation to allow it to be removed from the side of the bolt or nut regardless of the wrench's position relative to the bolt or nut. It is a further objective of the adjustable sliding jaw wrench of the present invention that it be easily and quickly adjustable to accommodate bolts and nuts of different sizes.

It is an additional objective of the adjustable sliding jaw wrench of the present invention that it be selectively operable to grip a bolt or nut to rotate the bolt or nut in either direction, or, if desired, in both directions. It is a related objective that the mechanism allowing the adjustable sliding jaw wrench of the present invention to operate in a ratcheting mode be easy to operate with a single hand, thereby enabling one-handed operation of the wrench to selectively tighten or loosen a bolt or nut. It is a further objective of the adjustable sliding jaw wrench of the present invention that, when locked, its jaws ensure a good grip on the bolt or nut being gripped, to thereby prevent the corners of the bolt or nut from being rounded off as the wrench is used.

The adjustable sliding jaw wrench of the present invention must be of a construction which is as simple and reliable as is possible, using a minimal number of moving parts, to thereby ensure that it is both durable and long lasting, and it should also require little or no maintenance to be provided by the user throughout its operating lifetime. In order to enhance the market appeal of the adjustable sliding jaw wrench of the present invention, it should also be of inexpensive construction to thereby afford it the broadest possible market. Finally, it is also an objective that all of the aforesaid advantages and objectives of the adjustable sliding jaw wrench of the present invention be achieved without incurring any substantial relative disadvantage.

SUMMARY OF THE INVENTION

The disadvantages and limitations of the background art discussed above are overcome by the present invention. This invention modifies the construction of a conventional open-end, sliding jaw wrench of the type having an adjustment mechanism operated by a worm gear and a mating rack. Such a wrench has a wrench head having a fixed jaw mounted at one end and a handle mounted at the other end, and a large rectangular opening located in the wrench head to accommodate a worm gear. A sliding jaw assembly having a moveable jaw supported from a rack member is mounted in the wrench head by installing the rack member in a receiver located in the wrench head, with rack teeth on the rack member extending partially into the large rectangular opening. A worm gear is mounted on a worm gear support spindle in the large rectangular opening in engagement with the rack member, and when the worm gear is rotated, it drives the rack teeth of the rack member to slide the sliding jaw assembly to thereby adjust the width between the fixed jaw and the moveable jaw.

The construction of the afore-mentioned sliding jaw wrench is modified in three respects by the adjustable sliding jaw wrench of the present invention. First, the worm gear is made substantially shorter than the width of the large rectangular opening in the wrench head in which the worm gear will be received. Second, when the shorter worm gear is mounted on the worm gear support spindle, a worm gear biasing spring is also installed on the worm gear support spindle to bias the worm gear in the direction in which the moveable jaw will move when it moves toward the fixed jaw.

Third, the wrench head is modified to receive a sliding locking member which moves between a locked position in which it will retain the worm gear in the position into which it is biased by the worm gear biasing spring and an unlocked position in which the worm gear is permitted to move in a direction opposing the worm gear biasing spring. In the preferred embodiment, a locking member biasing spring is used to bias the locking member in a direction from its unlocked position toward its locked position.

In operation, when the adjustable sliding jaw wrench of the present invention is used, the width between the adjustable jaw and the fixed jaw may be adjusted by using the worm gear as is conventional. With the locking member in its locked position, the adjustable sliding jaw wrench may be used as is conventional to rotate a bolt or a nut. When the locking member is moved to its unlocked position, the worm gear is free to slide on the worm gear support spindle against the bias of the worm gear biasing spring.

If the worm gear does so move, it will cause the rack member to move with it, sliding the moveable jaw away from the fixed jaw. If a bolt or a nut is received between the fixed jaw and the moveable jaw at the time, the bolt or nut will be free to rotate between the moveable jaw and the fixed jaw. As a practical matter, when the locking member is in its unlocked position and the wrench is rotated, bolt or nut will urge the moveable jaw away from the fixed jaw, thereby moving the rack member and the worm gear against the biasing spring and allowing the adjustable sliding jaw wrench of the present invention to in effect ratchet in its operation.

By repeatedly placing the locking member in its locked position when the wrench is rotated in one direction and in its unlocked position when the wrench is rotated in the opposite direction, the wrench will exhibit a ratcheting operation and will only drive the bolt or nut in the one direction. Similarly, by repeatedly placing the locking member in its unlocked position when the wrench is rotated in one direction and in its locked position when the wrench is rotated in the opposite direction, the wrench will exhibit a ratcheting operation and will only drive the bolt or nut in the opposite direction.

It may therefore be seen that the present invention teaches an adjustable sliding jaw wrench which has a ratcheting mode of operation allowing it to rotate a bolt or nut in a single direction only without requiring that the wrench periodically be removed from the bolt or nut to return it to an operable position. The adjustable sliding jaw wrench of the present invention is of open-end construction, and the jaws remain open-ended at all times during the wrench's operation to allow it to be removed from the side of the bolt or nut. The adjustable sliding jaw wrench of the present invention is easily and quickly adjustable to accommodate bolts and nuts of different sizes.

The adjustable sliding jaw wrench of the present invention is selectively operable to grip a bolt or nut and rotate it in either direction, or, if desired, in both directions. The mechanism allowing the adjustable sliding jaw wrench of the present invention to operate in a ratcheting mode is easy to operate with a single hand, thereby enabling one-handed operation of the wrench to selectively tighten or loosen a bolt or nut. When locked, the jaws of the adjustable sliding jaw wrench of the present invention ensure a good grip on the bolt or nut being gripped, thereby preventing the corners of the bolt or nut from being rounded off as the wrench is used.

The adjustable sliding jaw wrench of the present invention is of simple and reliable construction and uses a minimal number of moving parts, thereby ensuring that it is both durable and long lasting. It requires little or no maintenance to be provided by the user throughout its operating lifetime. The adjustable sliding jaw wrench of the present invention is of inexpensive construction to enhance its market appeal and thereby afford it the broadest possible market. Finally, all of the aforesaid advantages and objectives of the adjustable sliding jaw wrench of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
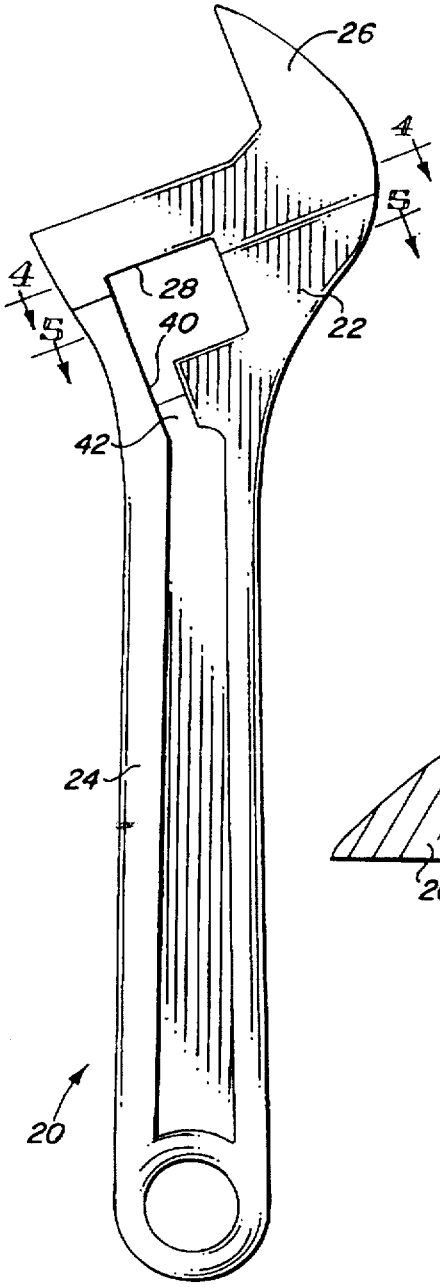
FIG. 1 is a plan view of a wrench body having a fixed jaw mounted on a wrench head at one end thereof and a handle mounted at the other end thereof, showing a large rectangular opening located in the wrench head to accommodate a worm gear (not illustrated in FIG. 1) and other components of the operating mechanism of the wrench (also not illustrated in FIG. 1), and also showing a smaller rectangular opening extending from the large rectangular opening.

The preferred embodiment utilizes as its basis a conventional open-end, sliding jaw wrench of the type having an adjustment mechanism operated by a worm gear and a mating rack. Modifications are made to such a sliding jaw wrench, and additional components are also utilized to complete the construction of the adjustable sliding jaw wrench of the present invention. During the following description of the construction of the adjustable sliding jaw wrench of the present invention, those portions that are conventional will be identified as such, and those portions that comprise modifications or additional components will likewise be identified as such.

Referring first to FIGS. 1 through 5, a wrench body 20 is illustrated which consists of a wrench head 22 having a handle 24 extending from one end thereof. The wrench head 22 has a fixed jaw 26 mounted at the other end thereof, which fixed jaw 26 is designed to grip one side of a bolt or nut or the like. The wrench body 20 is preferably cast or stamped out of steel, which is then machined. The wrench head 22 has a large rectangular opening 28 located therein which extends therethrough from the front side to the rear side of the wrench head 22. The large rectangular opening 28 is placed in the wrench head 22 to accommodate a worm gear (not illustrated in FIGS. 1 through 5). now particularly to FIGS. 2, 3, and 5, the placement of a threaded aperture 30 and an aperture 32 in the wrench head 22 on opposite sides of the large rectangular opening 28 is illustrated. The threaded aperture 30 is located on the side of the wrench head 22 which the large rectangular opening 28 is closest to, with the aperture 32 being located in the wrench head 22 on the opposite side of the large rectangular opening 28. The threaded aperture 30 and the aperture 32 are coaxial, and define a longitudinal axis parallel to the side of the large rectangular opening 28 opposite the handle 24.

Figure 4:
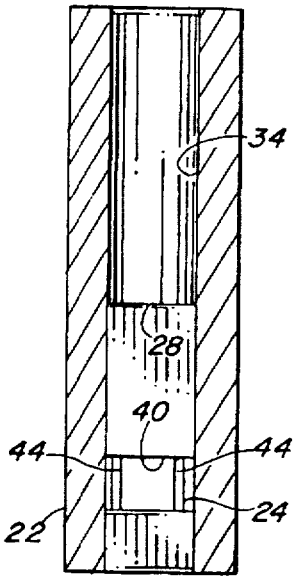
FIG. 4 is a second cross-sectional view of the wrench head illustrated in FIGS. 2 and 3, also showing the construction of the receiver into which the rack member of a moveable jaw assembly (not illustrated in FIG. 4) will be mounted.
Figure 3:
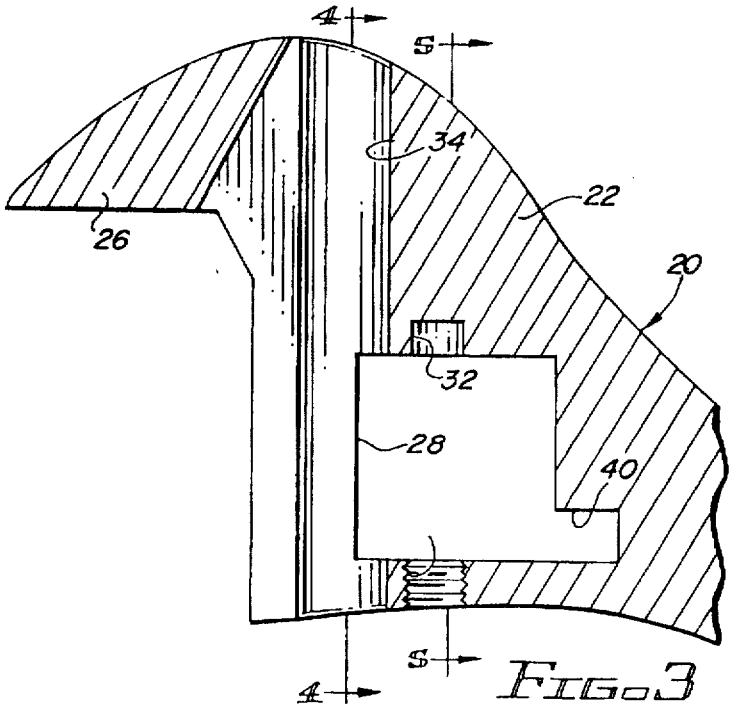
FIG. 3 is a cross-sectional view of the wrench head illustrated in FIG. 2, showing the construction of the receiver into which the rack of a moveable jaw assembly (not illustrated in FIG. 3) will be mounted.
Figure 2:
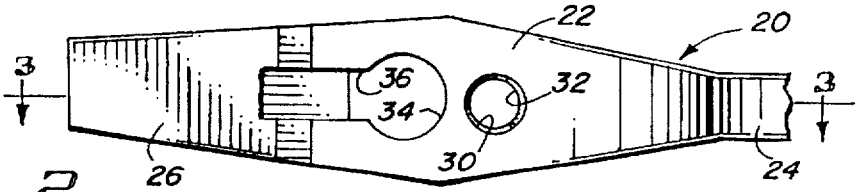
FIG. 2 is a side view of the wrench head of the wrench body illustrated in FIG. 1, showing apertures which will be used to support a worm gear (not illustrated in FIG. 2), and also showing a receiver into which a moveable jaw assembly (also not illustrated in FIG. 2) will be mounted.

Referring now particularly to FIGS. 2, 3, and 4, also located in the wrench head 22 is a receiver 34 which is essentially cylindrical in configuration, and which extends laterally from one side of the wrench head 22 to the opposite side. Note that the axis of the receiver 34 is parallel to the axis extending between the threaded aperture 30 and the aperture 32. Also, note that the receiver 34 opens into the large rectangular opening 28, such that a cylindrical member (not illustrated in FIGS. 1 through 5) located in the receiver 34 will extend into the large rectangular opening 28.

A gap 36 is located between the front side and the rear side of the wrench head 22 on the side of the receiver 34 opposite the large rectangular opening 28, as best shown in FIG. 2. The receiver 34 opens into the gap 36. The construction of the wrench body 20 and the wrench head 22 as described thus far, including the handle 24, the fixed jaw 26, the large rectangular opening 28, the threaded aperture 30, the aperture 32, the receiver 34, and the gap 36 is of conventional sliding jaw wrench design.

Figure 5:
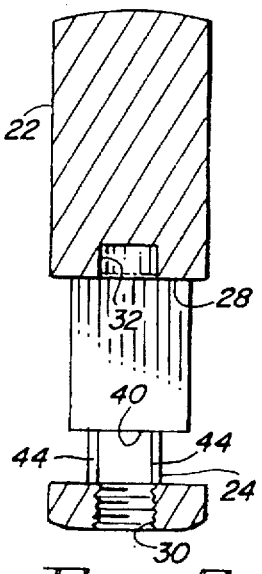
FIG. 5 is a third cross-sectional view of the wrench head illustrated in FIGS. 2 through 4, showing the configuration of the large opening to accommodate a worm gear (not illustrated in FIG. 5) and other components of the operating mechanism of the wrench (also not illustrated in FIG. 5)

The differences between the wrench body 20 of the adjustable sliding jaw wrench of the present invention and the wrench body of a conventional sliding jaw wrench design may now be described with reference to FIGS. 1 and 3 through 5. A smaller rectangular opening 40 extends from the large rectangular opening 28 on the side of the large rectangular opening 28 opposite from the receiver 34, adjacent the side of the large rectangular opening 28 in which the threaded aperture 30 is located. The portion of the wrench head 22 adjacent the side of the smaller rectangular opening 40 furthest from the large rectangular opening 28 is also milled on the front and back sides at locations identified by reference numerals 42 and 44, respectively, to a uniform thickness, as best shown in FIGS. 1, 4, and 5, to accept a locking member (not illustrated in FIGS. 1 through 5) thereon. The smaller rectangular opening 40 and the milled areas 42 and 44 on the front and back sides, respectively, of the wrench head 22 comprise the departures of the wrench head 22 of the adjustable sliding jaw wrench of the present invention from the construction of a conventional wrench head.

Figure 7:
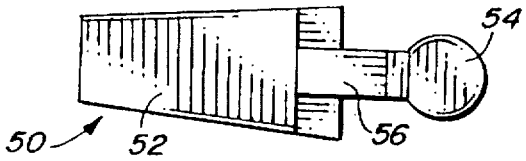
FIG. 7 is a side view of the sliding jaw assembly illustrated in FIG. 6, showing the cylindrical configuration of the rack member.
Figure 6:
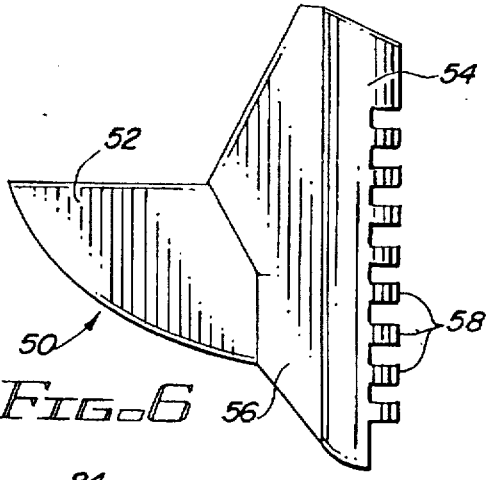
FIG. 6 is a plan view of a sliding jaw assembly having a moveable jaw and a rack member.

Referring next to FIGS. 6 and 7, a sliding jaw assembly 50 is illustrated which is of entirely conventional design. The sliding jaw assembly 50 is preferably cast out of steel which is then machined. The sliding jaw assembly 50 consists of a moveable jaw 52 which is attached to a cylindrical rack member 54 by a flat connecting fin 56 which extends therebetween. Located on the side of the rack member 54 opposite its connection to the connecting fin 56 are a plurality of spaced-apart notches which are orthogonal to the axis of the rack member 54, which notches form a plurality of rack teeth 58 on that side of the rack member 54. The construction of the sliding jaw assembly 50, including the moveable jaw 52, the rack member 54, the connecting fin 56, and the rack teeth 58, is entirely of conventional sliding jaw wrench design.

Figure 8:
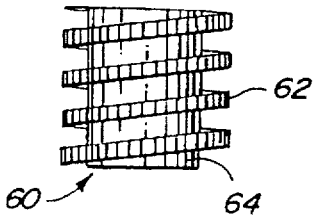
FIG. 8 is a plan view of a worm gear for installation into the large opening in the wrench head illustrated in FIGS. 1 and 3 through 5.
Figure 9:
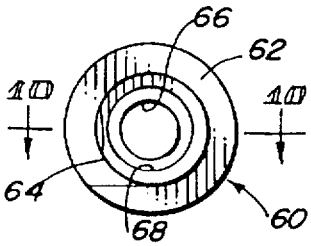
FIG. 9 is an end view of the worm gear illustrated in FIG. 8, showing a smaller aperture extending therethrough and a larger aperture extending partially therethrough.
Figure 10:
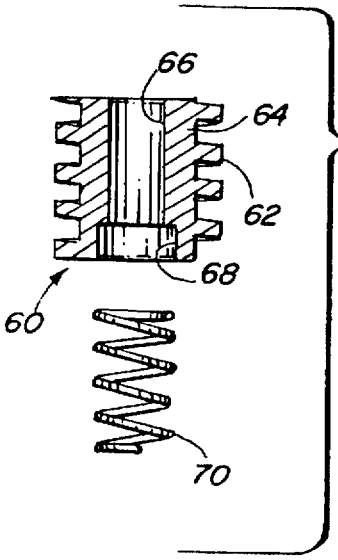
FIG. 10 is a cross-sectional view of the worm gear illustrated in FIG. 9, showing the relative configurations of the apertures located therein, and also showing in plan view a spring used to bias the worm gear in one direction.

Referring next to FIGS. 8 through 10, the construction of a worm gear 60 is illustrated. The worm gear 60 is preferably cast out of steel which is then machined. The worm gear 60 includes a spiral worm tooth 62 mounted on the outside of a worm cylinder 64. Note that the spiral worm tooth 62 is knurled on its outermost portion to facilitate its rotation by a user of the adjustable sliding jaw wrench of the present invention.

The worm gear 60 has a smaller aperture 66 extending axially through the worm cylinder 64, which smaller aperture 66 will be used to rotatably support the worm gear 60 from a support member (not illustrated in FIGS. 8 through 10) in the large rectangular opening 28 in the wrench head 22 (illustrated in FIG. 3) along the axis extending from the threaded aperture 30 to the aperture 32 (again illustrated in FIG. 3). The construction of the worm gear 60 as described thus far, including the spiral worm tooth 62, the worm cylinder 64, and the smaller aperture 66, is of conventional sliding jaw wrench design. However, note that the length of the worm gear 60 is much shorter than the worm gear of a conventional sliding jaw wrench would be (a conventional worm gear would extend from one side of the large rectangular opening 28 in the wrench head 22 to the other).

The differences between the worm gear 60 of the adjustable sliding jaw wrench of the present invention and the worm gear of a conventional sliding jaw wrench design may now be described with particular reference to FIGS. 9 and 10. Located inside one end of the worm cylinder 64 of the worm gear 60 is a larger aperture 68 which extends from one end of the worm gear 60 into the worm cylinder 64, but only goes partially therethrough the length of the worm cylinder 64. The larger aperture 68 is designed to admit one end of a worm gear biasing spring 70. The shorter length of the worm gear 60 and the larger aperture 68 extending partially therethrough comprise the departures of the worm gear 60 of the adjustable sliding jaw wrench of the present invention from the construction of a conventional sliding jaw wrench. The use of the worm gear biasing spring 70 is also a departure from the construction of a conventional sliding jaw wrench.

Figure 11:
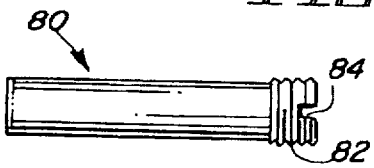
FIG. 11 is a plan view of a worm gear support spindle having a larger diameter threaded portion located at one end thereof.

Referring now to FIG. 11, a worm gear support spindle 80 is illustrated which is of essentially cylindrical construction, and which may be defined as having a proximal end (shown on the right in FIG. 11) and a distal end (shown on the left in FIG. 11). The worm gear support spindle 80 has a larger diameter threaded portion 82 located at the proximal end thereof. The worm gear support spindle 80 may be made out of steel with the larger diameter threaded portion 82 being machined.

The distal end of the worm gear support spindle 80 is designed to support the worm gear 60 (illustrated in FIGS. 8 through 10) thereon, with the distal end of the worm gear support spindle 80 being located in the aperture 32 of the wrench head 22 (illustrated in FIG. 3) and the larger diameter threaded portion 82 of the worm gear support spindle 80 being screwed into the threaded aperture 30 in the wrench head 22. To facilitate the worm gear support spindle 80 being screwed into the threaded aperture 30, the proximal end of the worm gear support spindle 80 has a notch 84 located therein to receive a screwdriver (not shown in FIG. 11). The construction of the worm gear support spindle 80, including the larger diameter threaded portion 82 and the notch 84, is entirely of conventional sliding jaw wrench design.

Figure 12:
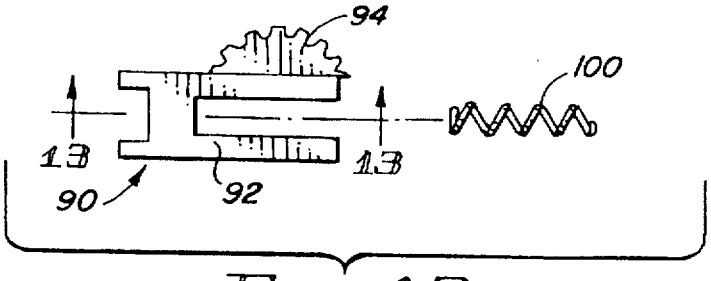
FIG. 12 is a plan view of a locking member which will be slideably mounted on the wrench head illustrated in FIGS. 1, 4, and 5 in the smaller rectangular opening therein, the locking member having an H-shaped body with a knurled semicircular projection extending therefrom, and also showing in plan view a spring used to bias the locking member in one direction.
Figure 13:
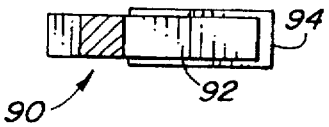
FIG. 13 is a cross-sectional view of the locking member illustrated in FIG. 12.

Referring next to FIGS. 12 and 13, a locking member 90 which will be slideably mounted on the milled, uniform thickness portions on the front and back sides of the wrench head 22 (illustrated in FIGS. 1, 4, and 5) at locations identified by reference numerals 42 and 44, respectively. The locking member 90 is preferably made out of steel which is machined. The locking member 90 has an H-shaped body 92 as illustrated in FIG. 12 (the H being oriented in sideways fashion), with the crossbar of the H being located such that the portions of the legs of the H shown on the right of the crossbar of the H in FIG. 12 are longer than are the portions of the legs of the H shown on the left of the crossbar of the H in FIG. 12.

A knurled semicircular projection 94 extends outwardly from the H-shaped body 92, from one of the longer portions of the legs of the H. The knurled semicircular projection 94 will be used as an actuating member to slide the locking member 90 back and forth on the milled, uniform thickness portions on the front and back sides of the wrench head 22 (illustrated in FIGS. 1, 4, and 5) at locations identified by reference numerals 42 and 44, respectively. The longer portions of the legs of the H are designed to admit one end of a locking member biasing spring 100. The use of the locking member 90 and the locking member biasing spring 100 are departures from the construction of a conventional sliding jaw wrench.

Figure 14:
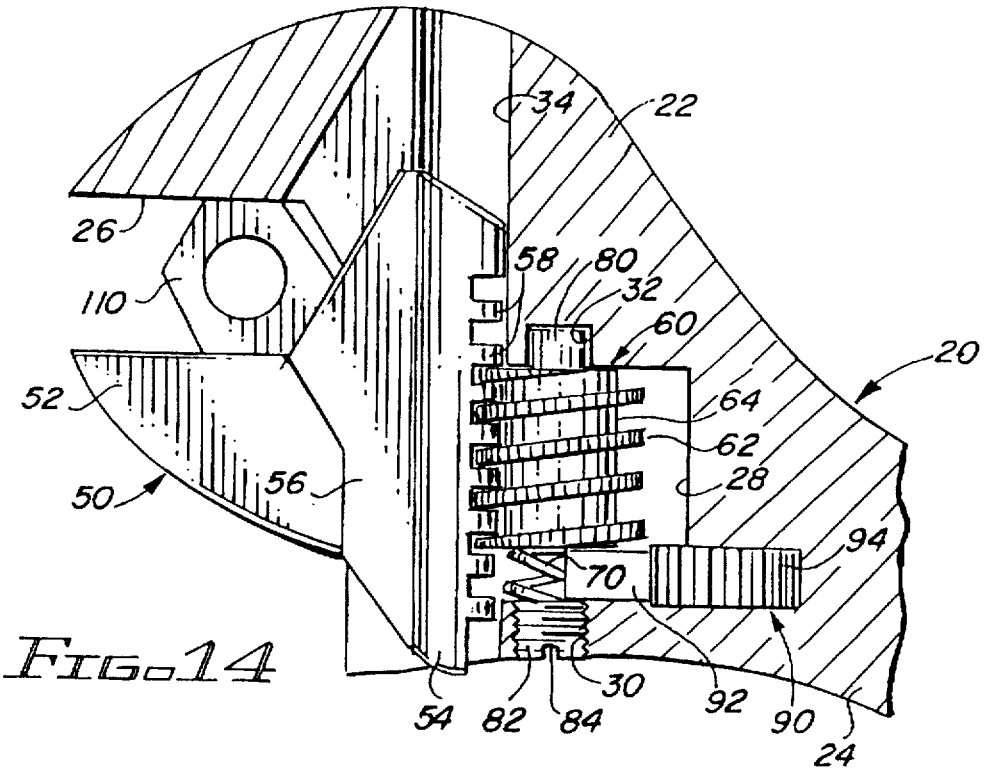
FIG. 14 is a first view of an assembled adjustable sliding jaw wrench with the wrench head being shown in cross-section without the handle attached thereto, showing the locking member in a locked position to allow the wrench to driveably engage a nut.
Figure 15:
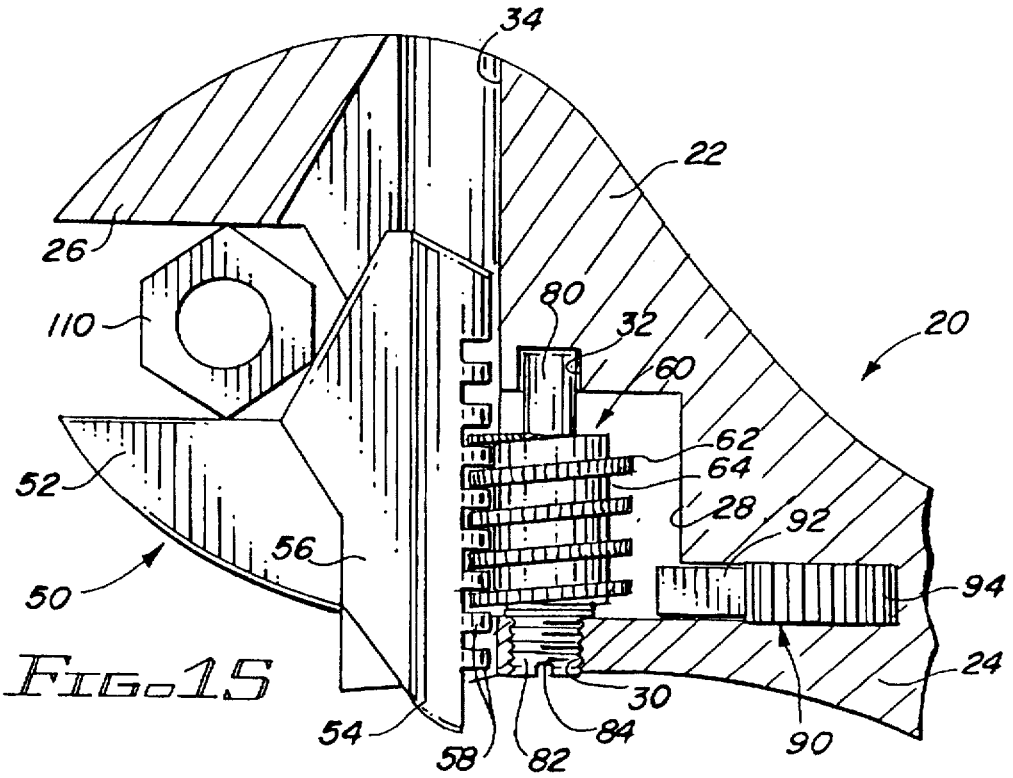
FIG. 15 is a second view of an assembled adjustable sliding jaw wrench similar to the view illustrated in FIG. 14, showing the locking member in an unlocked position to allow the wrench to be rotated without driveably engaging the nut.

Referring now to FIGS. 14 and 15, the assembly of the components illustrated in FIGS. 1 through 13 and described above may now be described. The rack member 54 of the sliding jaw assembly 50 is slid into the receiver 34 of the wrench head 22, such that the moveable jaw 52 faces the fixed jaw 26 in parallel fashion as shown. The rack teeth 58 of the sliding jaw assembly 50 extend into the large rectangular opening 28 in the wrench body 20 as shown.

The locking member biasing spring 100 is inserted into the longer portions of the legs of the H of the H-shaped body 92 of the locking member 90 (as illustrated in FIG. 12). The longer portions of the legs of the H are then slid over the milled, uniform thickness portions on the front and back sides of the wrench head 22 (illustrated in FIGS. 1, 4, and 5) at locations identified by reference numerals 42 and 44, respectively. It will be appreciated that the locking member biasing spring 100 urges the locking member 90 to the left in the views illustrated in FIGS. 14 and 15.

The worm gear biasing spring 70 is inserted into the larger aperture 68 of the worm gear 60 (illustrated in FIGS. 9 and 10). With the locking member 90 pushed fully to the right to compress the locking member biasing spring 100 (FIG. 12), the worm gear biasing spring 70 and the worm gear 60 are inserted into the large rectangular opening 28 in the wrench head 22. Note that the spiral worm tooth 62 of the worm gear 60 will mesh with the rack teeth 58 of the rack member 54 of the sliding jaw assembly 50.

The distal end of the worm gear support spindle 80 is inserted sequentially through the threaded aperture 30 in the wrench head 22, the worm gear biasing spring 70, and the smaller aperture 66 (illustrated in FIGS. and 10) in the worm cylinder 64 of the worm gear 60, and then into the aperture 32 in the wrench head 22. The larger diameter threaded portion 82 of the worm gear support spindle 80 may then be screwed into the threaded aperture 30 in the wrench head 22 using a screwdriver (not shown) inserted into the notch 84 in the worm gear support spindle 80. This completes the construction of the adjustable sliding jaw wrench of the present invention.

The principle of operation of the adjustable sliding jaw wrench of the present invention may now be discussed with reference to a nut 110. Note that the nut 110 has two significant dimensions, namely the first distance $D_1$ between two opposite sides of the nut 110 (such as the two opposite sides shown between the moveable jaw 52 and the fixed jaw 26 in FIG. 14), and the second distance $D_2$ between any two opposite corners of the nut 110 (such as the two opposite corners shown between the moveable jaw 52 and the fixed jaw 26 in FIG. 15). In a key design aspect of the adjustable sliding jaw wrench of the present invention, it is crucial that the width of the H-shaped body 92 of the locking member 90 be approximately as wide as the difference between the second distance $D_2$ and the first distance $D_1$ for the largest nut (or bolt or other like fastener) which the adjustable sliding jaw wrench is to be used with. This is because the width of the H-shaped body 92 of the locking member 90 defines the maximum distance which the worm gear 60 can move against the biasing force of the worm gear biasing spring 70.

By way of example, assume that the nut 110 is placed between the moveable jaw 52 and the fixed jaw 26. The worm gear 60 may be rotated to bring the moveable jaw 52 closer to the fixed jaw 26 to engage the nut 110 as illustrated in FIG. 14. Note that this adjustment is only performed with the locking member 90 in the position illustrated in FIG. 14, which is defined as the locked position. While the locking member 90 is in the locked position, the worm gear 60 is prevented from moving against the biasing force of the worm gear biasing spring 70.

Now, assume that the nut 110 has been rotated in the desired direction by the adjustable sliding jaw wrench of the present invention, and that the handle 24 of the wrench has encountered an obstruction. With conventional sliding jaw wrenches, the wrench would have to be removed from the nut the nut 110, repositioned, and then placed back onto the nut 110 again.

With the adjustable sliding jaw wrench of the present invention, however, the locking member 90 may be slid to the position illustrated in FIG. 15, which is defined as the unlocked position. In the unlocked position, note that the worm gear 60 is no longer blocked by the H-shaped body 92 of the locking member 90, and is free to move against the biasing force of the worm gear biasing spring 70.

Then, by moving the adjustable sliding jaw wrench in a direction opposite the desired direction of rotation of the nut 110, the nut 110 will bear against the fixed jaw 26 and exert force on the moveable jaw 52 to move it away from the fixed jaw 26 as illustrated in FIG. 15. As the fixed jaw 26 moves, the rack member 54 will also move in the receiver 34, and the rack teeth 58 will bear against the spiral worm tooth 62 of the worm gear 60. This will cause the worm gear 60 to move against the biasing force of the worm gear biasing spring 70. The nut 110 is thus allowed to rotate within the moveable jaw 52 and the fixed jaw 26. The net effect of the operation of the adjustable sliding jaw wrench of the present invention is that it will operate in a ratcheting fashion.

It may therefore be appreciated from the above detailed description of the preferred embodiment of the present invention that it teaches an adjustable sliding jaw wrench which has a ratcheting mode of operation allowing it to rotate a bolt or nut in a single direction only without requiring that the wrench periodically be removed from the bolt or nut to return it to an operable position. The adjustable sliding jaw wrench of the present invention is of open-end construction, and the jaws remain open-ended at all times during the wrench's operation to allow it to be removed from the side of the bolt or nut. The adjustable sliding jaw wrench of the present invention is easily and quickly adjustable to accommodate bolts and nuts of different sizes.

The adjustable sliding jaw wrench of the present invention is selectively operable to grip a bolt or nut and rotate it in either direction, or, if desired, in both directions. The mechanism allowing the adjustable sliding jaw wrench of the present invention to operate in a ratcheting mode is easy to operate with a single hand, thereby enabling one-handed operation of the wrench to selectively tighten or loosen a bolt or nut. When locked, the jaws of the adjustable sliding jaw wrench of the present invention ensure a good grip on the bolt or nut being gripped, thereby preventing the corners of the bolt or nut from being rounded off as the wrench is used.

The adjustable sliding jaw wrench of the present invention is of simple and reliable construction and uses a minimal number of moving parts, thereby ensuring that it is both durable and long lasting. It requires little or no maintenance to be provided by the user throughout its operating lifetime. The adjustable sliding jaw wrench of the present invention is of inexpensive construction to enhance its market appeal and thereby afford it the broadest possible market. Finally, all of the aforesaid advantages and objectives of the adjustable sliding jaw wrench of the present invention are achieved without incurring any substantial relative disadvantage.

Although an exemplary embodiment of the adjustable sliding jaw wrench of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. An adjustable sliding jaw wrench comprising:

a) a wrench head having a receiving aperture extending in a lateral direction within said wrench head, said wrench head having a fixed jaw mounted at a first end thereof and a handle extending from a second end thereof which is opposite said first end thereof, said wrench head also having a large opening defined therein, a portion of said receiving aperture being in communication with said large opening in said wrench head;

b) a rack member slideably mounted in said receiving aperture, said rack member supporting a moveable jaw therefrom which moveable jaw faces said fixed jaw and moves respectively toward and away from said fixed jaw as said rack member slides within said receiving aperture in said wrench head;

c) a worm gear rotatably supported on a spindle within said large opening in said wrench head, said worm gear engaging said rack member such that either rotation or lateral movement of said worm gear drives said rack member to slide in said receiving opening in said wrench head, said worm gear being laterally slideable on said spindle between first and second lateral positions;

d) a worm gear biasing spring for laterally biasing said worm gear on said spindle in a direction from said second lateral position toward said first lateral position;

e) a locking member mounted on said wrench head for selective movement between locked and unlocked positions, said said locking member retaining said worm gear in said first lateral position when said locking member is in said locked position, said locking member allowing said worm gear to slide from said first lateral position to said second lateral position when said locking member is in said unlocked position;

f) wherein said locking member is mounted on said wrench head such that when said locking member is in said locked position, said locking member extends between a first end of said worm gear and a side of said large opening in said wrench head to positively prevent said worm gear from sliding from said first lateral position toward said second lateral position;

g) a smaller opening located in said wrench head adjacent to and in communication with said large opening in said wrench head, said smaller opening in said wrench head extending from said large opening in said wrench head in a direction orthogonal to said lateral direction, said smaller opening in said wrench head being located adjacent the side of said large opening in said wrench head toward which said worm gear moves when it moves from said first lateral position to said second lateral position; wherein said locking member is H-shaped, with the bottom portions of the legs of the H being configured to fit over the portion of said wrench head adjacent the side of said smaller opening in said wrench head which is located furthest from said large opening in said wrench head, and the top portions of the legs of the H being configured to fit over said spindle and said spring.

2. An adjustable sliding jaw wrench as defined in claim 1, wherein said locking member additionally comprises:

a knurled semicircular projection extending outwardly from an outer side of said lower portion of one of the legs of said H-shaped locking member, said knurled semicircular projection functioning as an actuating member which may be used to slide said locking member between said locked and unlocked positions.

* * * * *